US009415420B2

(12) United States Patent
Smith

(10) Patent No.: US 9,415,420 B2
(45) Date of Patent: Aug. 16, 2016

(54) LAMINATED SCREENS

(75) Inventor: Joseph L. Smith, Cincinnati, OH (US)

(73) Assignee: M-I L.L.C., Houston, TX (US)

( * ) Notice: Subject to any disclaimer, the term of this patent is extended or adjusted under 35 U.S.C. 154(b) by 499 days.

(21) Appl. No.: 12/485,672

(22) Filed: Jun. 16, 2009

(65) Prior Publication Data

US 2009/0308795 A1 Dec. 17, 2009

Related U.S. Application Data

(60) Provisional application No. 61/061,906, filed on Jun. 16, 2008.

(51) Int. Cl.
*B07B 1/46* (2006.01)

(52) U.S. Cl.
CPC ..... *B07B 1/4663* (2013.01); *B07B 1/4618* (2013.01); *B07B 1/46* (2013.01); *Y10T 29/49826* (2015.01)

(58) Field of Classification Search
CPC ..... B07B 1/46; B07B 1/4609; B07B 1/4618; B07B 1/4663; B07B 1/4672; B07B 2201/02
USPC ..... 209/400, 401, 403, 405
See application file for complete search history.

(56) References Cited

U.S. PATENT DOCUMENTS 3,684,091 A * 8/1972 Wehner ..... B01D 29/00 209/399
5,385,241 A * 1/1995 Bokor ..... B07B 1/469 209/399
5,673,797 A * 10/1997 Bakula et al. ..... 209/392
5,876,552 A * 3/1999 Bakula ..... 156/308.2
6,202,856 B1 * 3/2001 Carr ..... 209/401
6,209,726 B1 * 4/2001 Gallia ..... 209/397
6,220,448 B1 * 4/2001 Bakula et al. ..... 209/392
6,286,687 B1 * 9/2001 Schuller ..... 209/325
6,325,216 B1 * 12/2001 Seyffert et al. ..... 209/408
6,431,368 B1 * 8/2002 Carr ..... 209/403
7,303,079 B2 12/2007 Reid-Robertson et al.
7,316,321 B2 * 1/2008 Robertson ..... B01D 29/012 209/400
7,682,996 B2 * 3/2010 Carr ..... 442/229
7,757,864 B2 * 7/2010 Barrett et al. ..... 209/274
7,810,649 B2 * 10/2010 Robertson ..... 209/401
2002/0033358 A1 3/2002 Bakula
2002/0104611 A1 * 8/2002 Adams et al. ..... 156/229
2003/0042179 A1 * 3/2003 Adams et al. ..... 209/408
2004/0007508 A1 * 1/2004 Schulte et al. ..... 209/403
2004/0102117 A1 5/2004 Carr
2004/0112522 A1 * 6/2004 Ward et al. ..... 156/290

(Continued)

OTHER PUBLICATIONS

Extended European Search Report issued in corresponding European Application No. 09162770.3; Dated Jul. 31, 2012 (11 pages).

(Continued)

*Primary Examiner* — Joseph C Rodriguez
(74) *Attorney, Agent, or Firm* — Osha Liang LLP

(57) ABSTRACT

A laminate screen for a vibratory separator, the screen including a product screen mesh layer having a plurality of wires. The screen further including a structural screen mesh layer having a plurality of wires secured to the product screen mesh layer with a thermoplastic polymer, wherein the structural screen mesh layer is configured to provide structural integrity to the laminate screen, and wherein a diameter of the product screen mesh layer wires is less than a diameter of the structural screen mesh layer wires.

6 Claims, 4 Drawing Sheets

(56) References Cited

U.S. PATENT DOCUMENTS

| | | | | |
|---|---|---|---|---|
| 2007/0125688 | A1 | 6/2007 | Ballman et al. | |
| 2008/0083660 | A1* | 4/2008 | Gallia | 209/405 |
| 2009/0301943 | A1* | 12/2009 | Bigelow | 209/399 |

OTHER PUBLICATIONS

Partial European Search Report Issued in European Application No. 09162770.3, Dated Apr. 12, 2012 (7 Pages).

* cited by examiner

LAMINATED SCREENS

CROSS-REFERENCE TO RELATED APPLICATION(S)

This application, pursuant to 35 U.S.C. §119(e), claims priority to U.S. Provisional Application Ser. No. 61/061,906, filed Jun. 16, 2008. That application is incorporated by reference in its entirety.

BACKGROUND

1. Field of the Disclosure

Embodiments disclosed herein relate generally to apparatuses and methods of assembling screens for vibratory separators. More specifically, embodiments disclosed herein relate to apparatuses and methods of assembling laminated screens for vibratory separators.

2. Background Art

Vibratory separators have long been used for the separation of both dry and wet materials, and are used in industries as varied as the chemical, food and beverage, powder coating, pharmaceutical, plastic, pulp and paper, ceramic, oilfield, and laundry industries. Vibratory separators, as used herein, generally refer to any type of separator or sifter used in the industrial processing of materials. Examples of materials and applications of industrial separators include metal powder, flour, sugar grinding, salt, steel shot, meat meal, sugar scalping, plastics, resin, fertilizer, petroleum coke, pharmaceuticals, wheat, soybean and oilseed, pellets and crumbles, and clay. Such separators may be circular or rectangular in cross section, and may include a vibration-generating device and resiliently mounted housings. Screens are fixed to the vibratory housings such that material fed to the vibrating screens may be screened. Various vibratory motions may be employed to work the material on the screen in the most advantageous manner. Frequently, discharge openings are provided both above the screening mechanism and below for retrieving the separated materials.

Some factors for selecting a particular vibratory separator include general material information, material characteristics, wet material data, material safety information, separator efficiency requirements, and desired use for the vibratory separator. For example, general material information may include the material to be screened, the temperature of the material, bulk density, specific gravity, and particle shape (spherical, fibrous, platelet, etc.). Materials may be characterized as granular, powder, abrasive, electrostatic, sticky, corrosive, free flowing, and agglomerates, among other characterizations. Key wet material data may include whether the material is viscous, greasy/oily, thixotropic, paste-like, sticky, or fatty. Furthermore, standard process data such as feed rate and minimum/maximum percentage of solids are important factors for selection of a vibratory separator. MSDS information, including numbers representing the severity of health, flammability and reactivity may be important depending on industry and application. Efficiency requirements vary by industry and application and are also important factors. Finally, those of ordinary skill in the art will appreciate that a vibratory separator may be used to scalp, dedust, or dewater, among other alternative uses.

In operation, a vibratory separator may be actuated to provide a flow of materials through the vibratory separator, such that solid particles are divided according to relative size. Thus, as the materials flow over a screen, larger particles exit the vibratory separator through a discharge outlet, while smaller particles exit through a secondary discharge area. The screen may include one or more filtering elements that may be manufactured from metals, plastics, cloth, and/or composites. Screens may be selected based on mesh size or micron size, among other sizing selection alternatives.

Over time, screens may be exposed to erosive and/or corrosive substances and operational conditions that degrade the screen effectiveness or efficiency of the filtering elements. Examples of operational conditions that may cause such an effect include typical actuation of the vibratory separator to impart movement in vertical and lateral directions. Over time, the vibratory motion, for example, in the vertical direction, may decrease the integrity of the screens due to structural damage, filtering element loosening, and the like. Such decreases in integrity may manifest as a slackening of the screen or parting of the screen from the frame, frame warpage or failure, or failure of the filtering element at the intersection with the frame. Further, screen failure may result from a broken screen, a screen tear, or bypass around a screen from improper sealing.

Screen failure may result in oversized particles entering the discharge underflow line of a vibratory separator. In wet screening of certain products, a maximum particle size may be important to manufacturing processes, and failure to screen to such a maximum size may lead to a large amount of final product being rejected or having to be reworked at a significant expense.

Accordingly, there exists a need for screens for use in the separation of dry and wet materials.

SUMMARY OF THE DISCLOSURE

In one aspect, embodiments disclosed herein relate to a laminate screen for a vibratory separator, the screen including a product screen mesh layer having a plurality of wires. The screen further including a structural screen mesh layer having a plurality of wires secured to the product screen mesh layer with a thermoplastic polymer, wherein the structural screen mesh layer is configured to provide structural integrity to the laminate screen, and wherein a diameter of the product screen mesh layer wires is less than a diameter of the structural screen mesh layer wires.

In another aspect, embodiments disclosed herein relate to a method of assembling a laminate screen for a vibratory separator, the method including selecting a product screen mesh layer and selecting a structural screen mesh layer. The method further including disposing a thermoplastic layer between the product screen mesh layer and the structural screen mesh layer, laminating the product screen mesh layer to the structural screen mesh layer to produce a laminate screen, and forming a retaining portion along at least a portion of the laminated screen.

In another aspect, embodiments disclosed herein relate to a vibratory separator including a first screen frame, a second screen frame disposed below the first screen frame, and a laminated screen disposed between the first screen frame and the second screen frame.

Other aspects and advantages of the invention will be apparent from the following description and the appended claims.

DETAILED DESCRIPTION

Embodiments disclosed herein relate generally to apparatuses and methods of assembling screens for vibratory separators. More specifically, embodiments disclosed herein relate to apparatuses and methods of assembling laminated screens for vibratory separators.

Screens for vibratory separators have traditionally been manufactured from composite or carbon steel structural supports with one or more layers of screen mesh disposed thereon. The screen mesh is typically attached to the structural supports through the use of glues, such as epoxy resins, and then sealed with other materials, such as silicon. Additionally, traditional screens include structural components used to pretension the screens, or may otherwise include attachment structures for securing the screens to the vibratory separator. Such traditional screens often fail during use due to a loss of structural integrity from failing structural support members, loss of tensioning, seal failure, etc. Embodiments disclosed herein provide alternative screens and methods of assembling such screens for use in wet and/or dry separatory operations.

Figure 1:
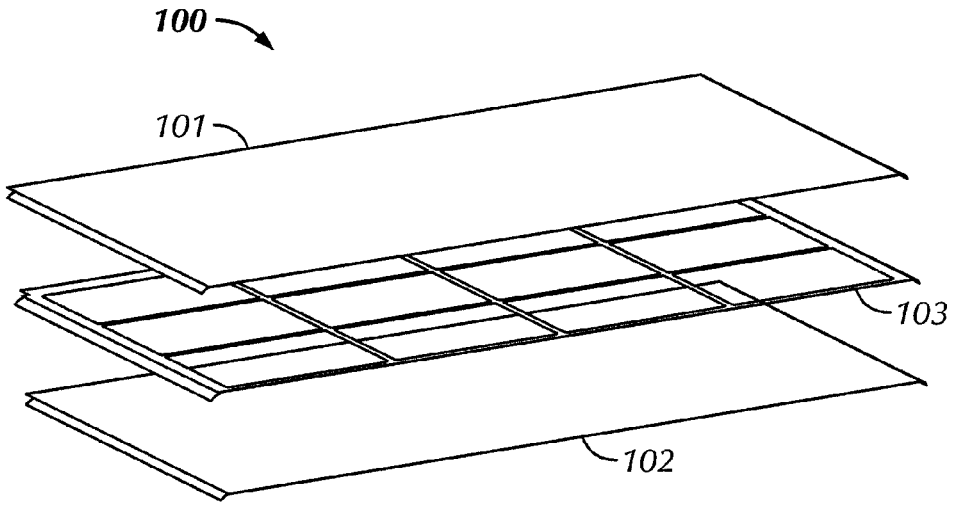
FIG. 1 is a breakaway perspective view of a screen according to embodiments of the present disclosure.
Figure 2:
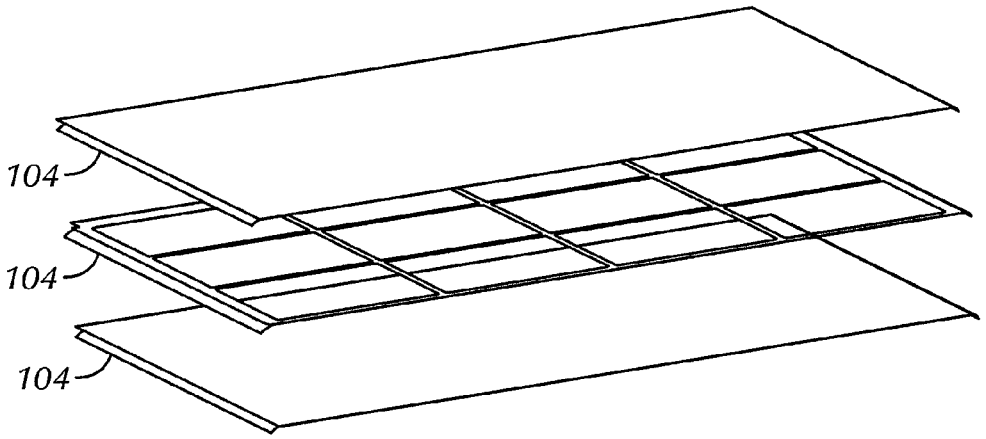
FIG. 2 is a breakaway perspective view of a screen according to embodiments of the present disclosure.

Referring to FIGS. 1 and 2, breakaway perspective views of screens according to embodiments of the present disclosure are shown. Separator screen 100, prior to the completion of manufacturing, includes three layers, a product screen mesh layer 101, a structural screen mesh layer 102, and a thermoplastic layer 103.

Product screen mesh layer 101 may be formed from a plurality of wires interwoven to provide a mesh having perforations of a desired size. The perforation size may be changed by, for example, varying the number of wires used, the spacing of the wires, and the diameter of the wires. A range of wire diameters may be used in constructing product screen mesh layer 101. Exemplary ranges include wires having a diameter of between 0.0008 inches to 0.0075 inches. By decreasing the diameter of the wire, more wires may be used, thereby resulting in a smaller perforation size, and allowing finer materials to be separated. Similarly, by increasing the diameter of the wires, perforation size may be increased, and coarse materials may thus be separated with greater efficiency. The diameter of the wires, as well as the number of wires and layout of the wires may be changed based on the material being separated and design requirements of the operation. Furthermore, those of ordinary skill in the art will appreciate that the wires may be formed from a number of different materials, for example, stainless steel and/or heat resistant polymer.

Structural screen mesh layer 102 may also be formed from a plurality of wires interwoven to provide a mesh having perforations of a desired size. Generally, the wires used to form structural screen mesh layer 102 will have a greater diameter than the wires used to form product screen mesh layer 101. Thus, structural screen mesh layer 102 provides a coarse screen surface relative to the fine screen surface of product screen mesh layer 101. Exemplary ranges of wire diameter for structural screen mesh layer 102 include wires ranging in diameter between 0.012 inches and 0.135 inches. Those of ordinary skill in the art will appreciate that generally, increasing wire diameter results in a more rigid mesh. Thus, the diameter of the wire used in constructing structural screen mesh layer 102 may be varied to achieve a desired rigidity for the screen.

When selecting a wire diameter size for structural screen mesh layer 102, a wire diameter greater than the diameter of wire used in product screen mesh layer 101 should be selected. By using a layer of screen mesh with greater wire diameter (structural screen mesh layer 102) relative to the wire diameter used for product screen mesh layer 101, screen 100 may have increased structural integrity after assembly. Structural integrity, as used herein, refers to a level of rigidity of the screen for a particular application. A screen with structural integrity may have greater rigidity, and thus less flexibility, than a screen without structural integrity. Those of ordinary skill in the art will appreciate that generally, the wire diameters used for product screen mesh layer 101 will not provide sufficient structural integrity to support a screen when installed in a vibratory separator, without additional components. In the present disclosure, structural screen mesh layer 102 provides the rigidity to screen 100 that is necessary for the screen to have structural integrity.

Thermoplastic layer 103 is a layer of thermoplastic material that may be used to secure product mesh screen layer 101 to structural mesh screen layer 102. The specific thermoplastic used may vary depending on the requirements of the separatory operation. For example, separation of product in the food or pharmaceutical industries may require use of a different thermoplastic than separation of products in the drilling and refining industries. Additionally, the thermoplastic may vary depending on the melting temperature of the wires that form product screen mesh layer 101 and/or structural screen mesh later 102. Various thermoplastic materials may be used, so long as the melting temperature of the thermoplastic material is less than the melting temperature of the wire of product screen mesh layer 101 and/or structural screen mesh later 102. Examples of thermoplastics that may be used in accordance with embodiments of the present disclosure include polypropolyene, polyethylene, polybutylene, polybutadiene, polyester, polyimide, polychlorotrifluoroethylene, polycarbonate, polyketone, polystyrene, and fluoroplastic. Those of ordinary skill in the art will appreciate that other thermoplastic materials may also be used in certain aspects. Similarly, those of ordinary skill in the art will appreciate that more than one thermoplastic material may be used in assembly of a screen.

During assembly, product screen mesh layer 101 and structural screen mesh layer 102 may be secured to one another by applying heat to thermoplastic layer 103. The assembly process for laminate screens in accordance with the present disclosure will be described below in detail. Initially, a product screen mesh layer 101 and a structural screen mesh layer 102 are selected for an operation. The perforations of product screen mesh layer 101 define the largest particle size that may pass through the screen, while structural screen mesh layer 102 is selected to include a larger diameter wire than product screen mesh layer 101, thereby providing structural integrity to the assembled screen.

After selection of desired screen mesh layers, thermoplastic layer 103 is disposed between product screen mesh layer 101 and structural screen mesh layer 102. The three layers, 101, 102, and 103 are then laminated together to produce a laminated screen 100. Lamination may include melting thermoplastic layer 103 disposed between products screen mesh layer 101 and structural screen mesh layer 102 to a specified temperature, such that thermoplastic layer 103 melts, thereby bonding product screen mesh layer 101 to structural screen mesh layer 102. The laminating may further include pressing product screen mesh layer 101, thermoplastic layer 103 and structural screen mesh layer 102 between two heated platens. Those of ordinary skill in the art will appreciate that one or more of the platens should be heated to a temperature at or above the melting point of thermoplastic layer 103 and below the melting point of the mesh layers 101 and 102. Furthermore, the temperature of the platens should be less than a temperature that may damage either product screen mesh layer 101 or structural screen mesh layer 102. For example, in an embodiment where the screen mesh layers are stainless steel and the thermoplastic layer is polypropylene, because polypropylene achieves flow properties sufficient to allow it to fuse the mesh layers together between 400° F. and 450° F., and the melting point of stainless is far greater than the melting point and flow rate of polypropylene, the polypropylene may fuse product screen mesh layer 101 to structural screen mesh layer 102 without damaging either layer.

Those of ordinary skill in the art will appreciate that other methods of assembling laminated screens in accordance with the present disclosure may also be possible. For example, rather than use platens to heat thermoplastic layer 103, in certain embodiments, heat may be applied to a particular area of screen 100 to laminate certain portions of screen 100. Such a process may allow for customized screens to be assembled for specialty applications. Additionally, the process of heating only a portion of screen 100 may allow for localized repairs of damaged screens.

After product screen mesh layer 101 is laminated with structural screen mesh layer 102, the thermoplastic will remain moldable for a short period of time. While the thermoplastic is moldable, additional features may be formed on screen 100, such as a retaining portion 104. Retaining portion 104 is a portion of at least structural screen mesh layer 102 that is bent into a desired configuration to allow the screen to be placed in a vibratory separator. In certain aspects, retaining portion 104 may include both product screen mesh layer 101 and structural screen mesh layer 102, while in other aspects, only structural screen mesh layer may be used to form retaining portion 104. Those of ordinary skill in the art will appreciate that due to the physical properties of thermoplastics, if retaining portion 104 is formed out of specification, the thermoplastic may be reheated, such that it is moldable again, and a desired shape of the screen reformed. The ability to reheat thermoplastics may also allow for product screen mesh layers 101 or structural screen mesh layers 102 to be replaced should they fail or become worn during use.

Figure 3:
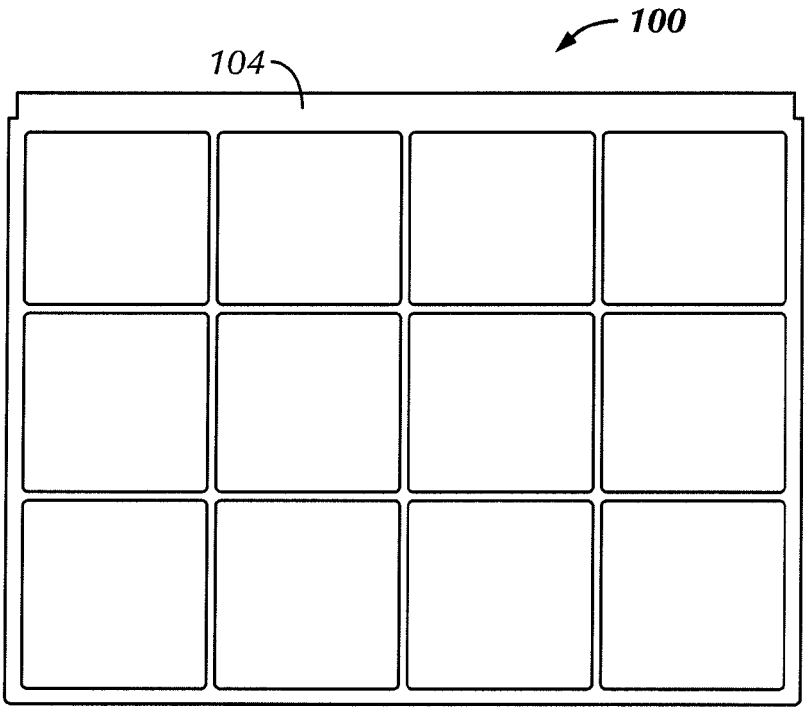
FIG. 3 is a top view of a screen according to embodiments of the present disclosure.
Figure 4:
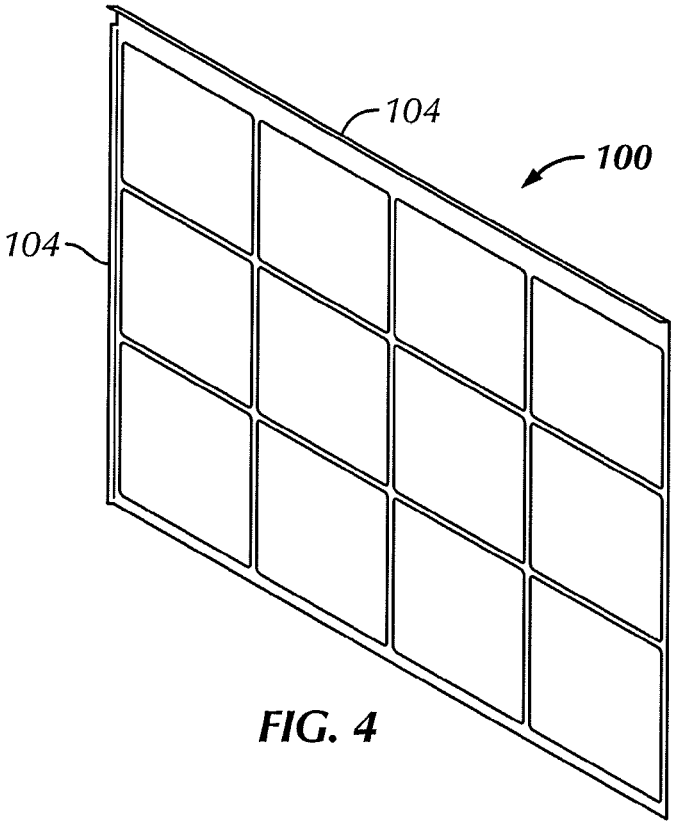
FIG. 4 is a perspective view of a screen according to embodiments of the present disclosure.
Figure 5A:
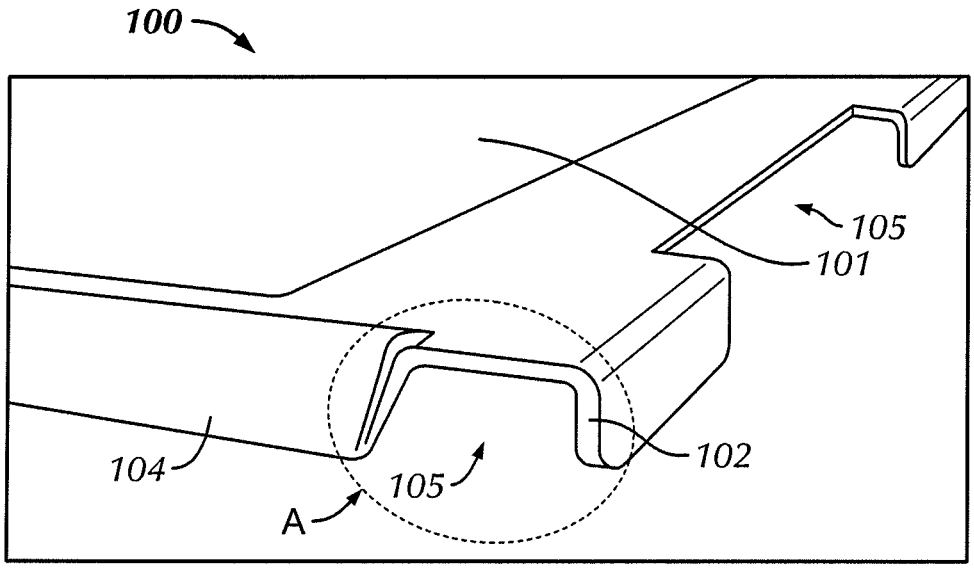
FIG. 5A is a side perspective view of a screen according to embodiments of the present disclosure.

Referring to FIGS. 3, 4, and 5A, top and side perspective views of laminated screens according to embodiments of the present disclosure are shown. In these embodiments, varied retaining portion geometries that may be formed after or during lamination are illustrated. Generally, retaining portions include a section of a screen 100 that is used to secure or otherwise hold screen 100 in place within a vibratory separator. Retaining portions may include, for example, flaps, extensions, and bent sections integrally formed from the structural and/or product screen mesh layers. Referring specifically to FIG. 3, screen 100 is formed to include a retaining portion 104 on one side of the periphery of the screen. Retaining portion 104 may be formed during assembly so that it may be used to secure screen 100 in a vibratory separator. Those of ordinary skill in the art will appreciate that additional features may be added to screens, such as holes for rivets, bolts, screws, or other attachment mechanisms to further secure screen 100 in a vibratory separator.

FIG. 4 also illustrates a screen 100 with retaining portions 104. In FIG. 4, screen 100 includes retaining portions 104 at two locations along the periphery of the screen. Retaining portions 104 are bent to a desired orientation, which may vary according to the type of vibratory separator they are designed to be installed in. In other aspects, retaining portions may be formed on three, four, or more surfaces, if the screen is either an irregular or nonrectangular shape.

Figure 5B:
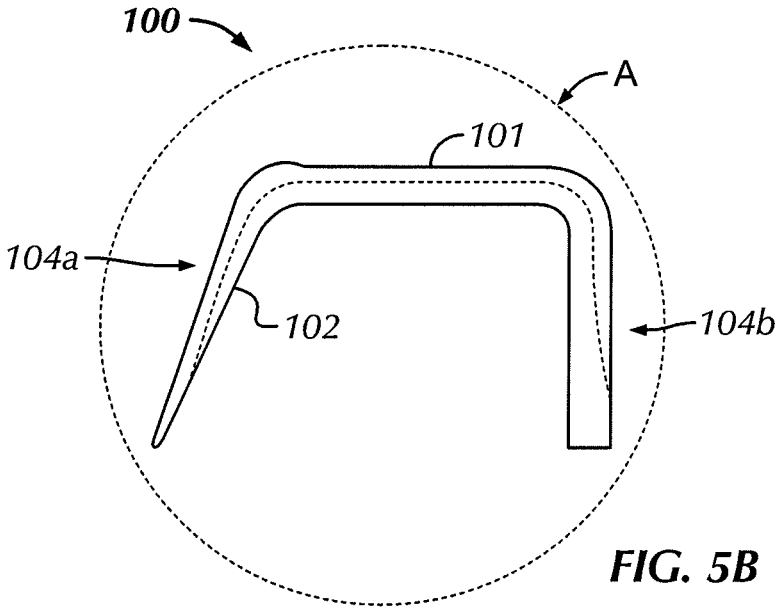
FIG. 5B is a close perspective view of a portion of FIG. 5A according to embodiments of the present disclosure.

FIG. 5A shows a perspective view of a corner portion of screen 100. Screen 100 illustrates product screen mesh layer 101 disposed on top of structural screen mesh layer 102. Referring briefly to FIG. 5B, a close-up view of section A of FIG. 5A is shown. FIG. 5B illustrates layering product screen mesh layer 101 on top of structural screen mesh layer 102. In this embodiment, both product and structural screen mesh layers 101 and 102 are bent to include a retaining portion 104, however, retaining portion 104A illustrates a tapered configuration wherein product screen mesh layer 101 extends further than structural screen mesh layer 102. In contrast, retaining portion 104B illustrates a tapering of product screen mesh layer 101, while structural screen mesh layer 102 extends to the periphery of screen 100. Those of ordinary skill in the art will appreciate that retaining portion 104 may be formed in various configurations of product and structural screen mesh layers 101 and 102.

Referring back to FIG. 5A, various design features may be present along the periphery of screen 100. In one aspect, screen 100 includes a plurality of notches 105 formed along retaining portion 104. The notches may be used to retain screen 100 in a vibratory separator, and as such, may be cut or formed after lamination of product and structural screen mesh layers 101 and 102. In still other aspects, screens 100 may include various design features, such as retaining portions 104 bent to specific orientations, notches 105, grooves (not shown), and/or attachment mechanisms (not shown).

Figure 6A:
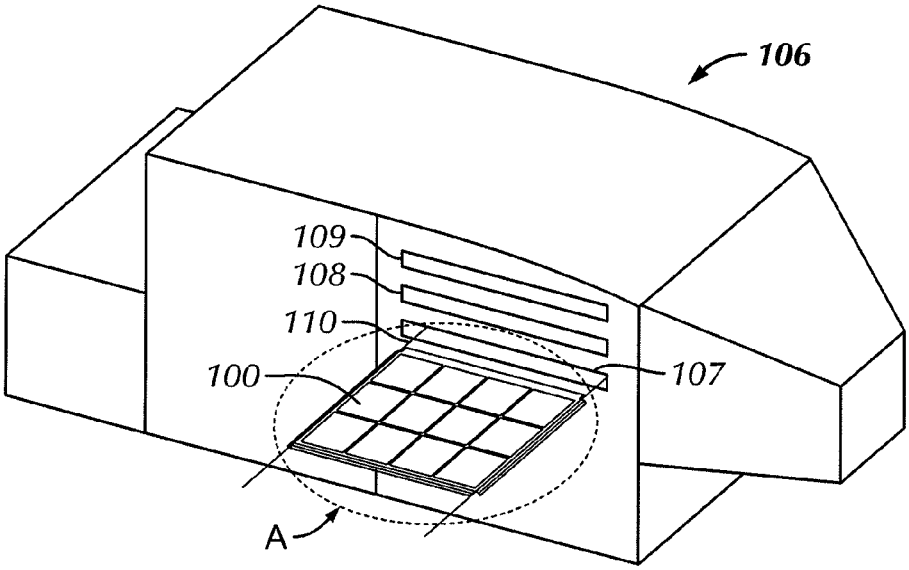
FIG. 6A is a vibratory separator according to embodiments of the present disclosure.

Referring to FIG. 6A, a perspective view of a vibratory separator according to embodiments of the present disclosure is shown. In this embodiment, vibratory separator 106 is illustrated having three screen slots 107 formed by a first screen frame 108 and a second screen frame 109. First screen frame 108 forms a top portion of the screen slot 107, while second screen frame 109 forms a bottom portion of the screen slot 107. Disposed within screen slot 107 are slidable trays 110 configured to allow a screen 100 to be placed thereon. Thus, screen 100 may be removed from vibratory separator 106 by sliding the trays 110 out of screen slot 107. In certain aspects screen 100 may be secured to trays, or other components of vibratory separator 106 with attachments mechanisms, such as screws, bolts, rivets, etc. Additionally, those of ordinary skill in the art will appreciate that other methods of disposing screens 100 within vibratory separator 106 are known in the art.

Figure 6B:
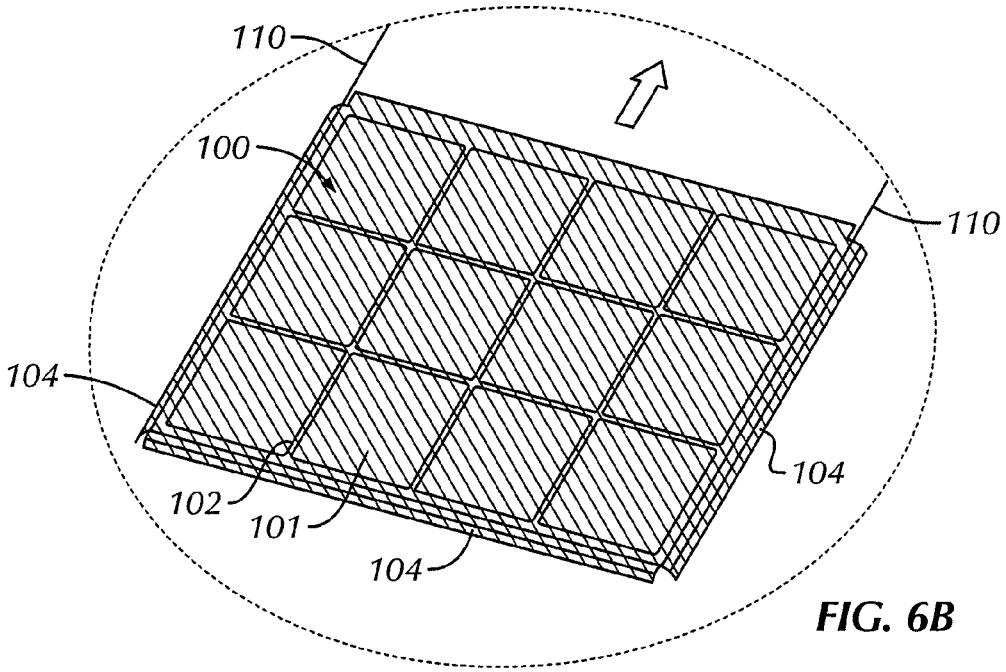
FIG. 6B is a close perspective view of a portion of FIG. 6A according to embodiments of the present disclosure.

Referring to FIG. 6B, a close perspective view of section B of FIG. 6A according to embodiments of the present disclosure is shown. In this embodiment, screen 100 is illustrated disposed on tray 110, which consists of rains extending from a vibratory separator body. Screen 100 includes retaining portions 104 disposed on three sides of screen 100, thereby allowing screen 100 to be slid onto tray 110 during installation, and slide off of tray 110 during replacement. Screen 100 also illustrates structural screen mesh layer 102 forming a widely spaced wire substrate. Product screen mesh layer 101 is illustrated as including a plurality of wires forming sized perforation to allow for the operation to produce a desired particle side distribution. Particle size distribution may be adjusted by changing the wire diameter, spacing, and number of wires used to form the mesh, as discussed above.

Advantageously, embodiments of the present disclosure may provide for screens for vibratory separators, including sifters, that use thermoplastic to secure a product screen mesh to a structural screen mesh. Because the wire diameter of the structural screen mesh is greater than the wire diameter of the product screen mesh, the structural screen mesh may provide structural integrity to the screen without requiring the use of screen frames and/or components to provide tension to the mesh. Thus, the mesh provides the structural integrity for the screen.

Also advantageously, embodiments of the present disclosure may provide for screens for vibratory separators that do not require the use of additional seals and/or sealing compounds, such as epoxy resins. Because the thermoplastic secures the product screen mesh to the structural screen mesh without the use of frames, and the screen thus has requisite structural integrity, the mesh does not need to be bonded to a frame. Because there are no frames, neither physical seals nor sealing components have to be added to the screen frame. Thus, the screen frame is lighter, and does not require additional components that may increase the cost to produce the screen, as well as potentially result in screens that cannot be used in, for example, the food industry due to the use of toxic sealing compounds.

Furthermore, the screens may provide the advantage of allowing the screens to be disassembled and subsequently reassembled if the mesh becomes worn during use. Because the mesh layers are secured to one another with a thermoplastic, after use, the thermoplastic may be reheated, the mesh separated from one another, and then one of the mesh components may be replaced. The thermoplastic may then be reheated, once the replacement mesh is positioned appropriately, and the screen may be reformed. By recycling screen components, the cost of remanufacturing screens may be decreased, thereby decreasing the net cost of the separatory operation.

Also advantageously, because the products screen mesh is secured to the structural screen mesh with a thermoplastic, the resulting laminate screen may be shaped before the thermoplastic sets, thereby allowing for additional design features, such as retaining portions, to be integrally formed on the screen. Additional features that may be formed on the screen include alignment portions, notches, and attachment portions. Additionally, when the thermoplastic hardens, the screen may become pretensioned, thereby removing the need for pretensioning components from the screen. Removing the pretensioning components may decrease the cost of the screen. Because the screen does not require tensioning components, the screen may be handled and installed without distorting or inadvertently adjusting the tension of the screen wires.

Finally, the screens disclosed herein may provide the advantage of replacing a steel or carbon steel frame typically found in screens. By removing the carbon steel frame, the laminate frames are more corrosion resistant, thereby decreasing the likelihood of premature screen failure. Additionally, the thermoplastic bonding provides a more rigid screen, thereby easing installation, and improving its resistance to operational failure.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A laminate screen for a vibratory separator, the laminate screen comprising:

a product screen mesh layer comprising a plurality of wires;

a structural screen mesh layer comprising a plurality of wires secured to the product screen mesh layer with a thermoplastic polymer causing the structural screen mesh layer and the product screen mesh layer to be under tension; and a peripheral retaining portion along at least one side of the laminate screen, the retaining portion comprising a portion of the product screen mesh layer, a portion of the thermoplastic polymer and a portion of the structural screen mesh layer, wherein the peripheral retaining portion further comprises a first retaining portion having the product screen mesh layer extending further than the structural screen mesh layer and a second retaining portion having the structural screen mesh layer extending further than the product screen mesh layer, wherein the structural screen mesh layer is configured to provide structural integrity to the laminate screen, and wherein a diameter of the product screen mesh layer wires is less than a diameter of the structural screen mesh layer wires.

2. The laminate screen of claim 1, wherein the product screen mesh layer wires have a diameter ranging between 0.034 inches and 0.0008 inches.

3. The laminate screen of claim 1, wherein the structural mesh layer wires have a diameter ranging between 0.135 inches and 0.012 inches.

4. The laminate screen of claim 1, wherein the thermoplastic polymer comprises polypropylene.

5. The laminate screen of claim 1, wherein the thermoplastic polymer comprises at least one of polyethylene, polybutylene, polyhutadiene, polyester, polyimide, polychlorotrifluoroethylene, polycarbonate, polyketone, polystyrene, and fluoroplastic.

6. A laminate screen for a vibratory separator, the laminate screen comprising:

a product screen mesh layer comprising a plurality of wires;

a structural screen mesh layer comprising a plurality of wires;

a thermoplastic layer disposed between the product screen mesh layer and the structural screen mesh layer for securing the product screen mesh layer to the structural screen mesh layer; and at least one peripheral retaining portion along at least one side of the laminate screen, the at least one peripheral retaining portion comprising a corner portion having a first retaining portion having the product screen mesh layer extending further than the structural screen mesh layer and a second retaining portion having the structural screen mesh layer extending further than the product screen mesh layer to the periphery of the laminate screen.

* * * * *